US009340014B2

(12) United States Patent
Hitzlsperger et al.

(10) Patent No.: US 9,340,014 B2
(45) Date of Patent: May 17, 2016

(54) PREFIRE BEFORE PIXEL IN AN INSPECTION MODE

(71) Applicant: Oce Printing Systems GmbH & Co. KG, Poing (DE)

(72) Inventors: Florian Hitzlsperger, Poing (DE); Philippe Koerner, Munich (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 14/848,840

(22) Filed: Sep. 9, 2015

(65) Prior Publication Data

US 2016/0067964 A1 Mar. 10, 2016

(30) Foreign Application Priority Data

Sep. 9, 2014 (DE) ..... 10 2014 112 939

(51) Int. Cl.
*B41J 29/393* (2006.01)
*B41J 2/045* (2006.01)

(52) U.S. Cl.
CPC ..... *B41J 2/04588* (2013.01); *B41J 2/04586* (2013.01)

(58) Field of Classification Search
CPC ..... B41J 29/393; B41J 2/125; B41J 2/2146; B41J 2/14153; B41J 19/202; B41J 19/205; B41J 2/04506
See application file for complete search history.

(56) References Cited

U.S. PATENT DOCUMENTS 8,058,831 B2 * 11/2011 Ishikawa ..... B41J 19/202 318/484
8,567,896 B2 * 10/2013 Ueshima ..... B41J 2/04501 347/14
8,998,365 B2 * 4/2015 Hasegawa ..... B41J 29/393 347/14

FOREIGN PATENT DOCUMENTS

DE 601 01 297 T2 9/2004
DE 601 21 069 T2 1/2007
DE 699 38 385 T2 4/2009
EP 2 184 168 B1 2/2012

* cited by examiner

*Primary Examiner* — Lamson Nguyen
(74) *Attorney, Agent, or Firm* — Schiff Hardin LLP

(57) ABSTRACT

Described are a system and a method to activate an actuator for a first nozzle of a plurality of nozzles of an inkjet printing system. The inkjet printer system can be configured to generate triggers with a frequency for printing of a respective line of pixels by the plurality of nozzles. The frequency of the triggers can depend on a print speed of the inkjet printing system, and the print speed can be modifiable. A time period between two successive triggers can correspond to a total duration available to the first nozzle for an ink firing for printing of a pixel of the line. An indicator for a current print speed of the inkjet printing system can be determined. Depending on the indicator for the current print speed, a waveform for activation of an actuator can be defined to produce an ink firing for printing of the pixel of the line on the recording medium by the first nozzle within the total duration available at the current print speed. The waveform can be defined such that, depending on the indicator for the current print speed within the total duration available at the current print speed, the waveform includes: a prefire portion for excitation of a meniscus of the first nozzle without firing the ink droplet, and a fire portion for firing the ink droplet from the first nozzle.

11 Claims, 3 Drawing Sheets

PREFIRE BEFORE PIXEL IN AN INSPECTION MODE

CROSS REFERENCE TO RELATED APPLICATIONS

This patent application claims the benefit of German Patent Application No. 102014112939.3, filed Sep. 9, 2014, which is incorporated herein by reference in its entirety.

BACKGROUND

The exemplary embodiments described herein generally relate to devices and corresponding methods to increase the print quality of an inkjet printing system, including given a reduced printing speed.

Inkjet printing systems may be used for printing to recording media (paper, for example). For this, one or more nozzles may be used in order to spray, fire, or throw ink droplets onto the recording medium, and in order to thus generate a desired print image on the recording medium.

In operation, given inks that contain water components and solvent components, properties of the ink (the viscosity, for example) and/or properties of the droplet delivery from the nozzle (for example the droplet size, the droplet separation, the separation point in time, the flight behavior etc.) may change due to drying effects. A drying of the ink that begins within a nozzle therein for the most part produces a reduction of the achievable print quality, and may lead to a total failure of the nozzle.

EP2184168B1 describes an inkjet printing system in which a nozzle of the printing system is charged with a preparatory square wave pulse in order to prepare a printing system which reliably generates droplets with a small droplet size. DE69938385T2 describes an inkjet printer in which, after a longer printing pause, a prefire pulse may be generated before an ejection pulse. DE60121069T2 describes an inkjet printer that may switch between different resolutions in a primary scanning direction. DE60101297T2 describes an inkjet printer that may use different waveform elements for the ejection of ink.

SUMMARY

It is an object of the present disclosure to provide inkjet printing systems that have a uniformly high print quality given different printing speeds.

Described are a system and a method to activate an actuator for a first nozzle of a plurality of nozzles of an inkjet printing system. The inkjet printer system can be configured to generate triggers with a frequency for printing of a respective line of pixels by the plurality of nozzles. The frequency of the triggers can depend on a print speed of the inkjet printing system, and the print speed can be modifiable. A time period between two successive triggers can correspond to a total duration available to the first nozzle for an ink firing for printing of a pixel of the line. An indicator for a current print speed of the inkjet printing system can be determined. Depending on the indicator for the current print speed, a waveform for activation of an actuator can be defined to produce an ink firing for printing of the pixel of the line on the recording medium by the first nozzle within the total duration available at the current print speed. The waveform can be defined such that, depending on the indicator for the current print speed within the total duration available at the current print speed, the waveform includes: a prefire portion for excitation of a meniscus of the first nozzle without firing the ink droplet, and a fire portion for firing the ink droplet from the first nozzle.

BRIEF DESCRIPTION OF THE DRAWINGS/FIGURES

The accompanying drawings, which are incorporated herein and form a part of the specification, illustrate the exemplary embodiments of the present disclosure and, together with the description, further serve to explain the principles of the exemplary embodiments and to enable a person skilled in the pertinent art to make and use the exemplary embodiments.

Figure 3A:
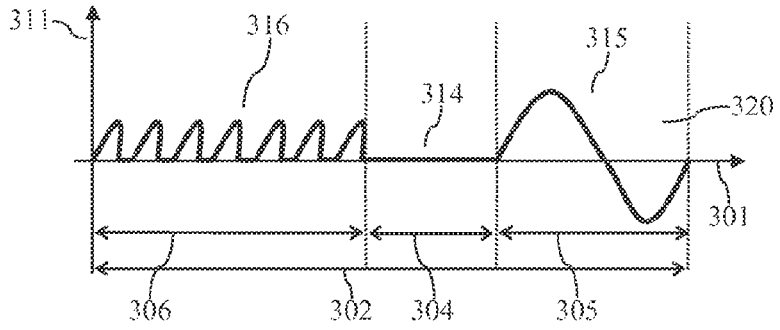
Figure 3B:
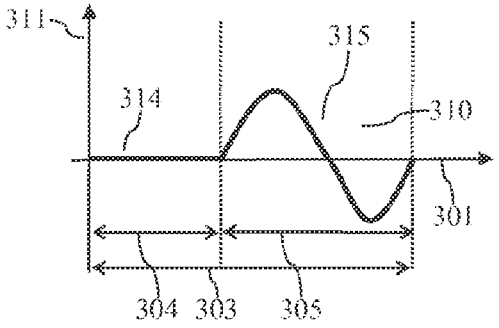

FIGS. 3*a* and 3*b* illustrate example waveforms for the activation of the actuator of a nozzle according to an exemplary embodiment of the present disclosure.

Figure 3C:
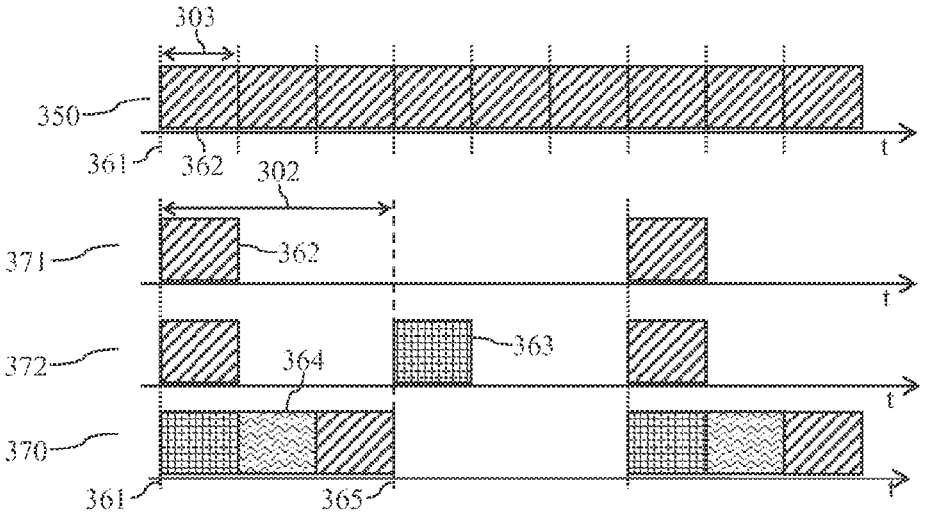

FIG. 3*c* illustrates example chronological sequences of pulses for activation of the actuator of a nozzle according to an exemplary embodiment of the present disclosure.

Figure 4:
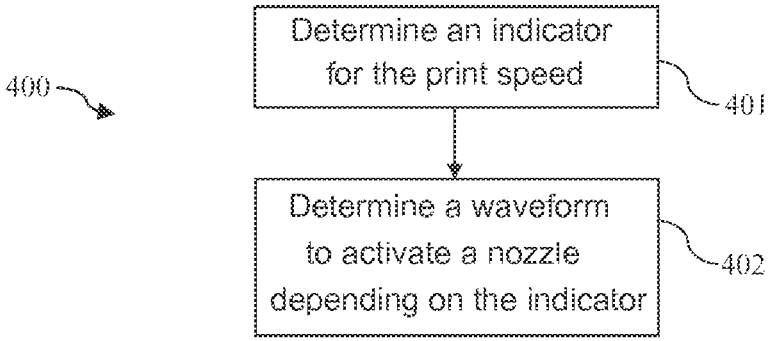

FIG. 4 illustrates a workflow diagram of an example method for activation of a nozzle of an inkjet printing system according to an exemplary embodiment of the present disclosure.

The exemplary embodiments of the present disclosure will be described with reference to the accompanying drawings. The drawing in which an element first appears is typically indicated by the leftmost digit(s) in the corresponding reference number.

DETAILED DESCRIPTION OF EXEMPLARY EMBODIMENTS

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

According to an exemplary embodiment, a method is described for activating a nozzle of an inkjet printing system. The method includes the determination of an indicator for a print speed of the inkjet printing system or, respectively, the determination of the print speed. Furthermore, the method includes the determination—depending on the indicator for the print speed or, respectively, depending on the print speed—of a waveform for activation of an actuator of the nozzle in order to produce an ink firing for the printing of a pixel on an recording medium. In addition to an ejection part (also designated as a fire part) for firing an ink droplet from the nozzle, depending on the indicator for the print speed or, respectively, depending on the print speed the waveform thereby also includes (typically immediately before the fire part) a prefire part for excitation of a meniscus of the nozzle without firing of an ink droplet.

According to an exemplary embodiment, a software (SW) program is described. The SW program may be configured to be executed on a processor, and in order to thereby execute one or more methods according to exemplary embodiments described herein.

According to an exemplary embodiment, a storage medium is described. The storage medium may include a SW program which is configured to be executed on a processor, and in order to thereby execute the method described in this document.

According to an exemplary embodiment, a controller for an inkjet printing system is described. The controller can be configured to control printing to a recording medium with different print speeds. The controller can be configured to determine an indicator for a current print speed or, respectively, to determine the current print speed of the inkjet printing system. Furthermore, the controller can be configured to define—depending on the determined indicator for the current print speed or, respectively, depending on the determined print speed—a waveform for activation of an actuator of the nozzle in order to produce an ink firing for the printing of a pixel on the recording medium. In addition to a fire part for ejection of an ink droplet from the nozzle, the waveform can also include a prefire part for excitation of a meniscus of the nozzle without firing an ink droplet. The addition of the prefire part can be based on the indicator for the current print speed or, respectively, depending on the current print speed.

According to an exemplary embodiment, an inkjet printing system is described that includes the controller described in this document.

Figure 1:
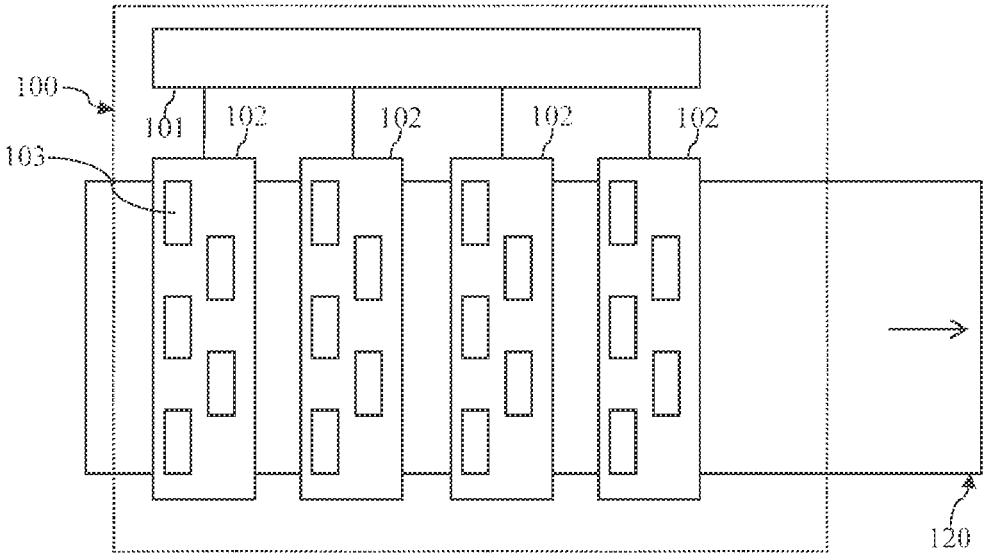
FIG. 1 illustrates a block diagram of an example inkjet printing system according to an exemplary embodiment of the present disclosure.

FIG. 1 shows a block diagram of an example inkjet printing system 100. The printing system 100 depicted in FIG. 1 can be configured for continuous printing, i.e. for printing to a "continuous" recording medium 120 (also designated as a "continuous feed"). The recording medium 120 can be unspooled from a roll (the take-off roll) and then supplied to the print group of the printing system 100. A print image is applied to the recording medium 120 via the print group, and after fixing/drying of the print image the printed recording medium 120 is taken up again on an additional roll (the take-up roll), or is cut into sheets. In FIG. 1, the movement direction of the recording medium 120 is represented by an arrow. The recording medium 120 may be made of paper, pasteboard, cardboard, metal, plastic and/or other suitable and printable materials.

In the depicted example, the print group of the printing system 100 comprises four print head arrangements 102 (which are also respectively designated as print bars). The different print head arrangements 102 may be used for printing with inks of different colors (for example black, cyan, magenta and/or yellow). The print group may comprise further additional print head arrangements 102 for printing with additional colors, or for printing with additional inks (for example MICR ink).

A print head arrangement 102 comprises one or more print heads 103. In the depicted example, a print head arrangement 102 comprises five respective print heads 103. The installation bearing/orientation of a print head 103 within a print head arrangement 102 may depend on the type of print head 103. Each print head 103 comprises one or more nozzles, wherein each nozzle is set up to fire or spray ink droplets onto the recording medium 120. For example, a print head 103 may comprise, for example, 2558 effectively utilized nozzles that are arranged along one or more rows transversal to the travel direction of the recording medium 120. The nozzles in the individual rows may be arranged offset from one another. A respective line on the recording medium 120 may be printed transversal to the travel direction by the nozzles of a print head 103. An increased resolution may be provided via the use of a plurality of rows with (transversally offset) nozzles. In total, 12790 droplets may thus be sprayed onto the recording medium 120 along a transversal line by a print head arrangement 102 depicted in FIG. 1. Each print head arrangement 100 may thus be set up to print a transversal line of a defined color on the recording medium 120 at a defined point in time.

In an exemplary embodiment, the printing system 100 can include a controller 101. The controller 101 can be configured to activate individual nozzles of individual print heads 103 to apply a print image onto the recording medium 120 depending on print data. The controller 101 can be, for example, an activation hardware and/or what is known as a "bar driving board." In an exemplary embodiment, the controller 101 can include processor circuitry that is configured to activate individual nozzles of individual print heads 103 to apply a print image onto the recording medium 120 depending on print data.

Figure 2:
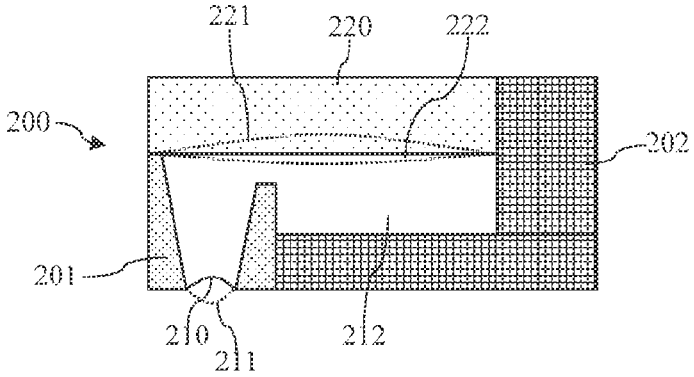
FIG. 2 illustrates a schematic design of an inkjet nozzle according to an exemplary embodiment of the present disclosure.

FIG. 2 shows an example design of a nozzle arrangement 200 of a print head 103. The nozzle arrangement 200 comprises walls 202 which form a receptacle or, respectively, a chamber to receive ink 212. An ink droplet may be sprayed onto the recording medium 120 via a nozzle 201 of the nozzle arrangement 200. The ink 212 forms what is known as a meniscus 210 at the nozzle 201. Furthermore, the nozzle arrangement 200 comprises an actuator 220 (for example a piezoelectric element) that is set up to modify the volume of the receptacle to receive ink 212 or, respectively, to modify the pressure in the chamber of the nozzle arrangement 200. In particular, the volume of the receptacle may be reduced by the actuator 220, and thus an ink droplet may be pushed out of the nozzle arrangement 200 via the nozzle 201. FIG. 2 shows a corresponding deflection 222 of the actuator 220. Moreover, the volume of the receptacle may be increased via the actuator 220 (see deflection 221) in order to draw new ink 212 into the receptacle or, respectively, into the chamber.

The ink 212 within the nozzle arrangement 200 may thus be moved via a deflection 221, 222 of the actuator 220. A defined movement of the actuator 220 thereby produces a correspondingly defined movement of the ink 212. The actuator 220 may be activated with defined waveforms or pulses to generate a movement of the actuator 220. In particular, via an ejection pulse (also designated as a fire pulse) to activate the actuator 220 it may be brought about that the nozzle arrangement 200 ejects an ink droplet via the nozzle 201. Alternatively or additionally, via a pre-ejection pulse (also designated as a prefire pulse) to activate the actuator 220 it may be brought about that, although the ink 212 is moved within the nozzle arrangement 200 and vibrates the meniscus 210 (see deflection 211), no ink droplet is thereby emitted from the nozzle arrangement 200. Such a prefire pulse for activation of the actuator 220 may be used to counteract drying effects of the ink 212 and to place the properties of the ink 212 (the viscosity, for example) and/or the properties of the droplet emission from the nozzle arrangement 200 (for example the droplet shape, the detachment, the detachment point in time, the flight behavior etc.) in a defined state in order to thus prepare an error-free ink firing.

The printing system 100 may be operated with different print speeds/travel velocities of the recording medium 120. For example, the printing system 100 may have what is known as an inspection mode in which the printing system 100 is operated with a reduced travel velocity (for example with 1/10th of the normal travel velocity of 1.6 meter/second, for example). Such an inspection mode enables an operator of the printing system 100 to review the functionality of the printing system 100 without thereby needing to halt the printing system 100, and without needing to generate spoilage connected with this.

Due to the reduced travel velocity, the frequency of ink firings of the individual nozzles 201 of the printing system 100 is also reduced. The reduced frequency of ink firings leads to an increase of the drying effects, and thus to a reduction of the print quality (for example due to first line effects, given which the first printed line has a reduced print quality due to the time period since the last ink firing, or due to nozzle failures).

Given "white pixels" (i.e. if no ink firing should take place at a point of the print image), one possibility to reduce the drying effects is to charge the individual nozzle arrangements 200 (i.e. the actuators 220) with prefire pulses in order to counteract the drying effects of said individual nozzle arrangements 200. Due to the typically relatively high number of "white pixels" in a print image to be printed, this leads to a relatively high loading (in particular to a relatively high heating) of the individual nozzle arrangements 200. Given older nozzle arrangements 200, this may in particular lead to a failure of nozzle arrangements 200.

Given reduced travel velocity (for example in an inspection mode), the time period between successive fire pulses for the successive pixels to be printed by a nozzle arrangement 200 is extended. This extended time period may be used in order to insert one or more prefire pulses before a fire pulse, via which one or more prefire pulses the nozzle arrangement 200—and in particular the nozzle 201—is prepared for the printing of a pixel. Furthermore, a pause time period may be inserted between the one or more prefire pulses and the fire pulse in order to ensure that the meniscus 210 is found in a defined state (for example in an oscillation-free state) at the point in time of the fire pulse, and thus has "recovered" again from the brief oscillation due to a prefire pulse. A print operation that is stable in the long term may be ensured via the pause time period.

A reliable ink firing of a nozzle arrangement 200 may be ensured via the insertion of one or more prefire pulses immediately before a fire pulse. The use of prefire pulses given "white pixels" may thus be foregone. In particular, prefire pulses may be used exclusively immediately before the printing of an actual (color, i.e. non-white) pixel. This means that the prefire pulses may take place (in combination with a fire pulse) in a time window that is provided for the printing of a "non-white" pixel. Neither a prefire pulse nor a fire pulse may take place in a time window that is provided for the "printing" of a "white" pixel, meaning that the actuator 220 of a nozzle arrangement 200 may remain in a rest state during such a time window. An excess loading (in particular an excess heating) of the nozzle arrangements 200 may thus be avoided via the use of prefire given "white pixels".

The controller 101 of the printing system 100 may be configured to determine a waveform for each (non-white) pixel of a print image that is to be printed, with which waveform the actuator 220 of the nozzle arrangement 200 should be activated in order to produce an ink firing from the nozzle 201 and in order to thus print a non-white" pixel in the recording medium 120. The waveform for the pixel to be printed may include a fire pulse via which the ink firing is produced. For example, the waveform may depend on the color and/or the color brightness of the pixel to be printed. For example, for the printing of continuous tones different droplet sizes (for example 5 picoliters, 7 picoliters or 12 picoliters) may be used depending on brightness. The firing of ink droplets of different droplet sizes may be produced via different waveforms (for example via fire pulses of different strength, or of modified fire pulses).

Alternatively or additionally, the waveform for a (non-white) pixel to be printed can be dependent on the travel velocity/print speed of the printing system 100. FIGS. 3*a* and 3*b* show example waveforms 310, 320 for different print speeds of the printing system 100. For example, the waveforms 310, 320 show the deflection 311 of the actuator 220 of a nozzle arrangement 200 over time 301. The waveforms 310, 320 can produce the ink firing for precisely one pixel to be printed during the time period 305.

The waveform 310 from FIG. 3*b* (which, in this document, is also designated as the first waveform 310) may, for example, be used given a relatively high print speed (for example at normal speed) of the printing system 100. The waveform 310 has a total duration 303, wherein the total duration 303 depends on the print velocity of the printing system 100 and the resolution of the print image in the travel direction (for example total duration 303=1/(travel velocity*resolution of the print image)). The total duration 303 corresponds to the time window that is available for the printing of a (non-white) pixel to be printed at a current print speed. The waveform 310 includes a pause portion 314 in the time period 304 in which the meniscus 210 of the nozzle 201 may settle from a preceding ink firing for a preceding pixel. Furthermore, the waveform 310 includes a fire portion 315 (with a fire pulse) in the time period 305 in order to produce a droplet firing for the pixel to be printed.

The waveform 320 from FIG. 3*a* (which is also designated as the second waveform 320 in this document) may, for example, be used given a relatively low print speed (for example given an inspection mode) of the printing system 100. In this case, the available total duration 302 of the waveform 320 which is available for the printing of a ("non-white") pixel is longer than the total duration 303 of the waveform 310. The additional available time period 306 may be used to insert a prefire portion 316 (with one or more prefire pulses) into the waveform 320. Using the prefire part 316, the drying effects of a nozzle 201 may be counteracted and the nozzle 201 may be prepared for the firing of an ink droplet. A high print quality may thus be ensured even at reduced print speed.

FIG. 3*c* shows an example of chronological sequences of pulses or, respectively, waveforms or, respectively, of waveform portions to activate an actuator 220. The sequence 350 shows a sequence of waveforms 362 (for example of first waveforms 310) for the firing of ink droplets for the normal print operation of an inkjet printing system 100. Each fire trigger 361 designated for a "non-white" pixel causes the generation of a corresponding waveform 362 with ink firing.

FIG. 3*c* furthermore shows example chronological sequences 370, 371 and 372 in an inspection mode. In the sequence 371, a waveform 362 for firing an ink droplet is generated in the event of a fire trigger 361 for a "non-white pixel." In the event of a trigger 365 for a "white pixel," the actuator 220 is not activated. As presented above, the relatively long time period between the pixels to be printed may lead to drying effects of the corresponding nozzle 201. In the sequence 372, "white prefire" is used, meaning that a waveform 363 with one or more prefire pulses without ink firing is generated in the case of a trigger 365 for a "white pixel". As presented above, however, this may lead to an overheating of a nozzle arrangement 200. The sequence 370 illustrates a method according to an exemplary embodiment. For example, for a fire trigger 361 for a "non-white" pixel, a waveform for activation of an actuator 220 is generated which includes a prefire portion 363, a pause portion 364 and a subsequent fire portion 362 as illustrated in FIG. 3*a*. Further, for a trigger 365 for a "white" pixel, no activation of the actuator 220 takes place. A high print quality may thus be achieved without overheating of the nozzle arrangements 200.

FIG. 4 shows a workflow diagram of an example method 400 to activate the actuator 220 of a nozzle 201 of an inkjet printing system 100. As presented above, the inkjet printing system 100 may be a printing system 100 in which a recording medium 120 is unspooled from a roller according to a print speed. The printing system 100 typically comprises a plurality of nozzles 201, of which a respective subset may be arranged in print heads 103. Multiple print heads 103 may be assembled into a print bar, or into a print head arrangement 102.

The method 400 comprises the determination 401 of an indicator for a (possibly current) print speed of the inkjet printing system 100. For example, the indicator for the print speed may include a print mode in which the inkjet printing system is found. Example print modes can include an inspection mode in which the printing system 100 is operated with a reduced print speed, or a standard print mode in which the printing system 100 is operated with a normal print speed (for example 1.6 meter/second). The normal print speed is thereby higher than the reduced print speed. For example, an additional print mode may be a transition phase or, respectively, a ramp from the inspection mode to the standard print mode, or vice versa. Alternatively or additionally, the indicator for the print speed may include a print speed set by an operator of the inkjet printing system 100. Furthermore, the indicator for the print speed may include a measurement value detected by a velocity sensor with regard to a travel velocity of the recording medium 120. Moreover, the indicator for the print speed may include the frequency of a trigger to print a line of pixels to the recording medium 120. For example, such a trigger may be generated by the inkjet printing system 100. The print speed typically coincides with a frequency of ink firings of the nozzle 201 of the printing system 100.

The method 400 additionally includes the determination 402—depending on the indicator for the print speed—of a waveform 310, 320 for activation of the actuator 220 of the nozzle 201 in order to produce an ink firing for the printing of a pixel on the recording medium 120. In particular, depending on the indicator for the print speed a waveform 310, 320 may be determined for each pixel to be printed with the nozzle. In operation, a waveform 310, 320 can include a fire portion 315 via which an ink firing is produced. Furthermore, depending in the indicator for the print speed (e.g., when the indicator indicates a relatively low print speed), the waveform 310, 320 may include a prefire portion 316 in which, although the ink 212 is moved in the nozzle 201, no ink firing takes place. The prefire portion 316 of a waveform 310, 320 is thereby arranged before (possibly immediately before) the fire portion 315 of the waveform 310, 320.

Drying effects of a nozzle 201 may effectively be remedied via the adaptation of the waveform 310, 320 for the ink firing of a pixel depending on the print speed. In particular, it may be ensured that—even given a reduced print speed (for example in an inspection mode)—a high print quality may be ensured (for example via the use of a waveform 320 with a prefire portion 316). Furthermore, the use of prefire pulses given the printing of "white pixels" may be omitted so that an overheating of the nozzles 201, and a nozzle failure connected with this, may be prevented and/or reduced. In particular, the actuator 220 may not be activated at all (i.e. with neither a prefire pulse nor a fire pulse) for the printing of "white pixels", meaning that the actuator 20 may be kept at rest.

For example, according to the method 400, the waveform 310, 320 may be selected in an inkjet printing system 100 for activation of the piezoelectric element 220 of a nozzle 201 depending on the print speed and/or on the printing mode. In particular, in an inspection mode, a waveform 320 may be selected with one or more prefire pulses in order to counteract drying effects of the nozzle 201 given relatively low print speeds.

The determination 402 may include the selection of a waveform 310, 320 from a plurality of predefined (typically different) waveforms 310, 320. For example, the plurality of predefined waveforms 310, 320 may be stored in a memory unit of the inkjet printing system 100. The plurality of predefined waveforms 310, 320 may include a first waveform 310 that includes a fire part 315 to fire an ink droplet from the nozzle 201. The first waveform 310 thereby typically includes no prefire part 316 for excitation of the meniscus 210 of the nozzle 201 without firing of an ink droplet. Furthermore, the plurality of predefined waveforms 310, 320 may include a second waveform 320 that includes a prefire portion 316 for excitation of the meniscus 210 of the nozzle 201 without firing of an ink droplet, and a fire portion 315. For example, the first waveform 310 may be used at relatively high print speeds in which, due to a relatively high frequency of ink firings, drying effects may typically be avoided. For example, the second waveform 320 may be used at relatively low print speeds in order to counteract drying effects given a relatively low frequency of ink firings.

The first waveform 310 and/or the second waveform 320 may respectively include a pause portion 314 to settle the meniscus 210 of the nozzle 201. In the pause portion 314, the actuator 220 for the nozzle 201 may be kept at rest. Via a settling of the meniscus 210 it may be ensured that the meniscus 210 is found in a defined state at the point in time of a fire pulse (in the fire portion 315), and thus a uniformly high print quality may be achieved.

The selection from a plurality of predefined waveforms 310, 320 may include the selection of the first waveform 310 if the print speed is greater than or equal to a speed threshold (for example if the printing system 100 is in a normal operating mode). Furthermore, the selection from a plurality of predefined waveforms 310, 320 may include the selection of the second waveform 320 if the print speed is less than the speed threshold (for example if the printing system 100 is in an inspection mode).

The total duration 302, 303 of a waveform 310, 320 typically depends on the print speed of the inkjet printing system. Given a reduction of the print speed, the total duration 303 of a waveform 320 used for this print speed may be extended. Due to the extended total duration 303, it is possible to incorporate a prefire portion 316 into the waveform 320, and to thereby counteract drying effects of the nozzle 201. Depending on the indicator for the print speed, a waveform 320 may thus be determined that—in addition to a fire portion 315 to fire an ink droplet from the nozzle 201—also includes a prefire portion 316 for excitation of the meniscus 210 of the nozzle 201 without firing an ink droplet. This prefire portion 316 can be arranged immediately before the fire portion 315 of the waveform 320 (possibly with an intervening pause portion 314).

As was already presented above, the waveform 310, 320 for an ink firing may also depend on one or more additional parameters, in addition to the indicator for the print speed. In particular, the waveform 310, 320 may depend on the desired size of the fired droplet.

Via the use of print speed-dependent waveforms for the firing of ink droplets, a uniformly high print quality may be achieved even given reduced print speed. Furthermore, the heating of a print head may be reduced since prefire pulses take place only before the printing of a non-white pixel, and thus the frequency of prefire pulses may be reduced. Furthermore, the method described in this document enables prefire to also be used in older print heads without causing a failure of the print heads. Moreover, the described method may be implemented efficiently in preexisting printing systems via the adaptation of the waveforms that are used.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this disclosure, the term "processor circuitry" shall be understood to be circuit(s), processor(s), logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. In one or more exemplary embodiments, the processor can include a memory, and the processor can be "hard-coded" with instructions to perform corresponding function(s) according to embodiments described herein. In these examples, the hard-coded instructions can be stored on the memory. Alternatively or additionally, the processor can access an internal and/or external memory to retrieve instructions stored in the internal and/or external memory, which when executed by the processor, perform the corresponding function(s) associated with the processor, and/or one or more functions and/or operations related to the operation of a component having the processor included therein.

In one or more of the exemplary embodiments described herein, the memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

100 printing system
101 controller of the printing system 100
102 print head arrangement
103 print head
120 recording medium
200 nozzle device
201 nozzle
202 wall
210 meniscus
211 deflection of the meniscus
212 ink
220 actuator (piezoelectric element)
221, 222 deflection of the actuator
301 time
302, 303 total duration of a waveform
304 pause time period
305 fire time period
306 prefire time period
311 deflection of the actuator
314 pause portion of the waveform
315 fire portion of the waveform
316 prefire portion of the waveform
310, 320 waveform
350 sequence of waveforms in normal print operation
361 fire trigger (for a "non-white" pixel)
362 waveform with ink firing
363 waveform without ink firing
364 pause
365 trigger for a "white" pixel
370, 371, 372 sequence for waveforms in an inspection mode
400 method to activate a nozzle
401, 402 method steps

What is claimed is:

1. A method to activate an actuator for a first nozzle of a plurality of nozzles of an inkjet printing system, the method comprising:

configuring the inkjet printer system to generate triggers with a frequency for printing of a respective line of pixels by the plurality of nozzles, the frequency of the triggers depending on a print speed of the inkjet printing system, the print speed being modifiable, a time period between two successive triggers corresponding to a total duration available to the first nozzle for an ink firing for printing of a pixel of the line;

determining an indicator for a current print speed of the inkjet printing system; and depending on the indicator for the current print speed, defining a waveform for activation of an actuator to produce an ink firing for printing of the pixel of the line on the recording medium by the first nozzle within the total duration available at the current print speed, the waveform being defined such that, depending on the indicator for the current print speed within the total duration available at the current print speed, the waveform includes: a prefire portion for excitation of a meniscus of the first nozzle without firing the ink droplet, and a fire portion for firing the ink droplet from the first nozzle.

2. The method according to claim 1, wherein the defining comprises selecting a waveform from a plurality of predefined waveforms; and the plurality of predefined waveforms comprise:

a first waveform that includes a fire portion to fire an ink droplet from the first nozzle without a prefire portion for excitation of the meniscus; and a second waveform that includes a prefire portion for excitation of the meniscus and a fire portion.

3. The method according to claim 2, wherein at least one of the first waveform and the second waveform further comprises a pause portion to settle the meniscus of the first nozzle.

4. The method according to claim 2, wherein the selecting the waveform comprises:

selecting the first waveform if the current print speed is greater than or equal to a speed threshold; and selecting the second waveform if the current print speed is less than the speed threshold.

5. The method according to claim 1, wherein a frequency of ink firings depends on the print speed.

6. The method according to claim 1, wherein the prefire portion comprises at least one prefire pulse before the fire portion within the total duration.

7. The method according to claim 1, wherein the indicator for the current print speed comprises one or more of:

a print mode of the inkjet printing system;

a print speed set by an operator of the inkjet printing system;

a measurement value detected by a velocity sensor indicative of a travel velocity of a recording medium; or the frequency of the trigger for printing the line of pixels on the recording medium.

8. An inkjet printing system configured to print to a recording medium with different print speeds, the inkjet printing system comprising:

a plurality of nozzles that are configured to print a line on the recording medium; and a controller that is configured to:

generate triggers with a frequency for printing of a respective line of pixels by the plurality of nozzles, the frequency of the triggers depending on the print speed of the inkjet printing system, wherein a time period between two successive triggers corresponds to a total duration that is available to a first nozzle of a plurality of nozzles for ink firing;

determine an indicator for a current print speed of the inkjet printing system; and define, based on the determined indicator, a waveform to activate an actuator for the first nozzle of the inkjet printing system to produce an ink firing to print the pixel of the line on the recording medium, wherein the waveform includes:

a prefire portion to excite a meniscus of the first nozzle without firing an ink droplet, and a fire portion for firing the ink droplet from the first nozzle.

9. The inkjet printing system according to claim 8, wherein the controller is configured to define the waveform for every pixel to be printed with the first nozzle.

10. The inkjet printing system according to claim 8, wherein the inkjet printing system is configured to unspool the recording medium from a roller according to the current print speed.

11. A method of controlling an inkjet printing system including a nozzle having an actuator, the method comprising:

determining an indicator for a current print speed of the inkjet printing system; and defining, based on the indicator of the current print speed, a waveform for activating the actuator to produce an ink firing to print a pixel by the nozzle, wherein the waveform is defined to include:

a prefire portion to excite a meniscus of the nozzle without firing an ink droplet, and a fire portion to fire the ink droplet from the nozzle.

* * * * *